US009091138B2

(12) United States Patent
Goddard et al.

(10) Patent No.: US 9,091,138 B2
(45) **Date of Patent: *Jul. 28, 2015**

(54) SYSTEM AND METHOD FOR PRODUCING HIGH PRESSURE FOAM SLURRY

(71) Applicant: Schlumberger Technology Corporation, Sugar Land, TX (US)

(72) Inventors: Brian Goddard, Stafford, TX (US); Roger Keese, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/165,362

(22) Filed: Jan. 27, 2014

(65) Prior Publication Data

US 2014/0138089 A1 May 22, 2014

Related U.S. Application Data

(63) Continuation of application No. 12/854,222, filed on Aug. 11, 2010, now Pat. No. 8,636,070, which is a continuation-in-part of application No. 12/852,088, filed on Aug. 6, 2010, now abandoned.

(51) Int. Cl.

| | |
|---|---|
| ***E21B 43/00*** | (2006.01) |
| ***E21B 33/13*** | (2006.01) |
| ***E21B 21/06*** | (2006.01) |

(52) U.S. Cl.

CPC ..... *E21B 33/13* (2013.01); *E21B 21/062* (2013.01); *E21B 43/00* (2013.01)

(58) Field of Classification Search

USPC ..... 166/279, 300, 305.1

See application file for complete search history.

(56) References Cited

U.S. PATENT DOCUMENTS

| | | | |
|---|---|---|---|
| 4,438,815 | A | 3/1984 | Eison et al. |
| 4,571,993 | A | 2/1986 | St. Onge |
| 4,797,003 | A | 1/1989 | Cameron et al. |
| 5,273,682 | A | 12/1993 | Danzik |
| 6,491,053 | B1 | 12/2002 | Briggeman et al. |

(Continued)

OTHER PUBLICATIONS

International Search Report and Written Opinion, Application No. PCT/IB2011-053354 dated Feb. 15, 2012.

(Continued)

*Primary Examiner* — William P Neuder

(74) *Attorney, Agent, or Firm* — Jeffrey Anderson; Rachel E. Greene; Tim Curington

(57) ABSTRACT

The current application discloses methods and systems for generating high pressure dual phase mixture. In some embodiments, the methods and systems involve mounting a dual phase mixture generator on a transportable platform wherein the dual phase mixture generator comprises a mixing chamber connected with at least a first inlet, a second inlet, and a first outlet. A first container and a first pump are also mounted on the transportable platform wherein the first pump is operably connected with the first container. The transportable platform and the mounted equipments are then deployed at a wellsite. A base fluid is pumped into the first inlet under high pressure, and a gas is pumped into the second inlet under high pressure. The base fluid and the gas is combined in the mixing chamber to generate a high pressure dual phase mixture, which is then discharged via the outlet.

19 Claims, 4 Drawing Sheets

(56) References Cited

U.S. PATENT DOCUMENTS

| | | | | |
|---|---|---|---|---|
| 7,234,524 | B2 | 6/2007 | Shaw et al. | |
| 7,677,883 | B2 | 3/2010 | Harless | |
| 8,636,070 | B2 * | 1/2014 | Goddard et al. | 166/300 |
| 2009/0068031 | A1 | 3/2009 | Gambier et al. | |
| 2011/0153229 | A1 | 6/2011 | Goddard et al. | |

OTHER PUBLICATIONS

International Preliminary Report on Patentabiligy, Application No. PCT/IB2011-053354 dated Feb. 12, 2013.

Mexican Office Action for corresponding Mexican Application Serial No. MX/a/2013/001478 dated Aug. 7, 2014 with English translation, 4 pgs.

* cited by examiner

SYSTEM AND METHOD FOR PRODUCING HIGH PRESSURE FOAM SLURRY

RELATED APPLICATION DATA

This application claims priority as a continuation of U.S. patent application Ser. No. 12/854,222, filed Aug. 11, 2010 as a continuation in part application of U.S. patent application Ser. No. 12/852,088 filed Aug. 6, 2010, which is incorporated by reference herein. Both of these are incorporated by reference herein.

BACKGROUND OF THE INVENTION

The statements in this section merely provide background information related to the present disclosure and may not constitute prior art.

In oil field well servicing applications, fluids can be foamed to create a dual phase system (i.e. bi-phase fluid) consisting of both gas and liquid phases. One example of the dual phase system is a foamed slurry which may be a cement or sand and water. A foamed cement slurry is particularly useful in certain oilfield operations.

U.S. Pat. No. 4,797,003 discloses an apparatus and process for uniformly dispersing gas through a slurry to provide a stable foam slurry, the entire content of which is incorporated herein by reference.

Co-pending and co-assigned U.S. patent application Ser. No. 12/641,380, filed on Dec. 18, 2009, discloses a method and system for monitoring the production of a bi-phase fluid, the entire content of which is also incorporated herein by reference.

However, there remains a need to further improve the system and method for generating high qualify bi-phase fluid, such as foamed cement slurries for use at the wellsite. Currently, the foaming process requires the setup of a system that comprises multiple equipments scattered over a relatively large area operated by multiple workers/personnel. The setup includes both the conventional cementing equipment utilized for non-foamed operations and those highly specialized equipments for foam generation, mixing and delivery. Moreover, many foaming operations are requested by wellsite workers/personnel on a pro hoc basis, a significant amount of equipment handlings and pipe connections are typically required at the site of the operation. This reduces the efficiency of the operation and may compromise the quality and safety of the project. Accordingly, it is desirable to have systems and methods with reduced amount of equipment and pipe handling at the site of operation, so foam generating processes may be quickly and safely delivered. This application aims to address one or more problems associated with the current foamed cement operations.

SUMMARY

According to one aspect, there is provided a method of generating high pressure dual phase mixture. The method comprises mounting a dual phase mixture generator on a transportable platform where the dual phase mixture generator comprises a mixing chamber connected with at least a first inlet, a second inlet, and a first outlet. The method further comprises mounting a first container and a first pump on the transportable platform where the first pump is operably connected with the first container. The method additionally comprises deploying the transportable platform at a wellsite, introducing a base fluid into the first inlet under high pressure, introducing a gas into the second inlet under high pressure, combining the base fluid with the gas in the mixing chamber to generate a high pressure dual phase mixture, and discharging the generated high pressure dual phase mixture via the outlet.

According to another aspect, provided are systems for generating high pressure dual phase mixtures. The systems comprise a transportable platform, a dual phase mixture generator mounted on the transportable platform, a first container mounted on the transportable platform and operably connected with a first pump mounted on the transportable platform. The dual phase mixture generator comprises a mixing chamber connected with at least a first inlet, a second inlet, and a first outlet. The first inlet is configured to receive a base fluid under high pressure, the second inlet is configured to receive a gas under high pressure, the mixing chamber is configured to combine the base fluid and the gas to generate a high pressure dual phase mixture, and the outlet is configured to discharge the generated high pressure dual phase mixture for use at the wellsite, such as injecting the mixture into a well located at the wellsite.

BRIEF DESCRIPTION OF THE DRAWINGS

These and other features and advantages will be better understood by reference to the following detailed description when considered in conjunction with the accompanying drawings.

DETAILED DESCRIPTION OF SOME ILLUSTRATIVE EMBODIMENTS

Some embodiments relate generally to systems and methods for producing high pressure foam slurry for use in wellbores penetrating a subterranean formation.

As used herein, the term "high pressure" means a pressure that is substantially higher than atmospheric pressure. In some cases, the high pressure is at least about 1000 psi, inclusive. In some other cases, the high pressure is at least about 2500 psi, inclusive. In some further cases, the high pressure is at least about 5000 psi, inclusive. In yet some other cases, the high pressure is at least about 7500 psi, inclusive. In some additional cases, the high pressure is at least about 10,000 psi, inclusive, or at least about 15,000 psi, inclusive, or any other pressures readily conceivable by people skilled in the art in view of the teachings of the current application.

As used herein, the term "base fluid" may comprise a fluid, a liquid, a solid, a gas, and combinations thereof, as will be appreciated by those skilled in the art. Additionally, the term "liquid" or "fluid" is used in a broad sense, including traditional liquids such as water and dissolved solutions, as well as mixtures of solids and liquid such as suspensions and slurries. In particular, as used herein, the term "base fluid" includes cement slurries for use in the oil and gas industry, with or without additives such as foaming agent, stabilizing agent, and the combination thereof.

Figure 1:
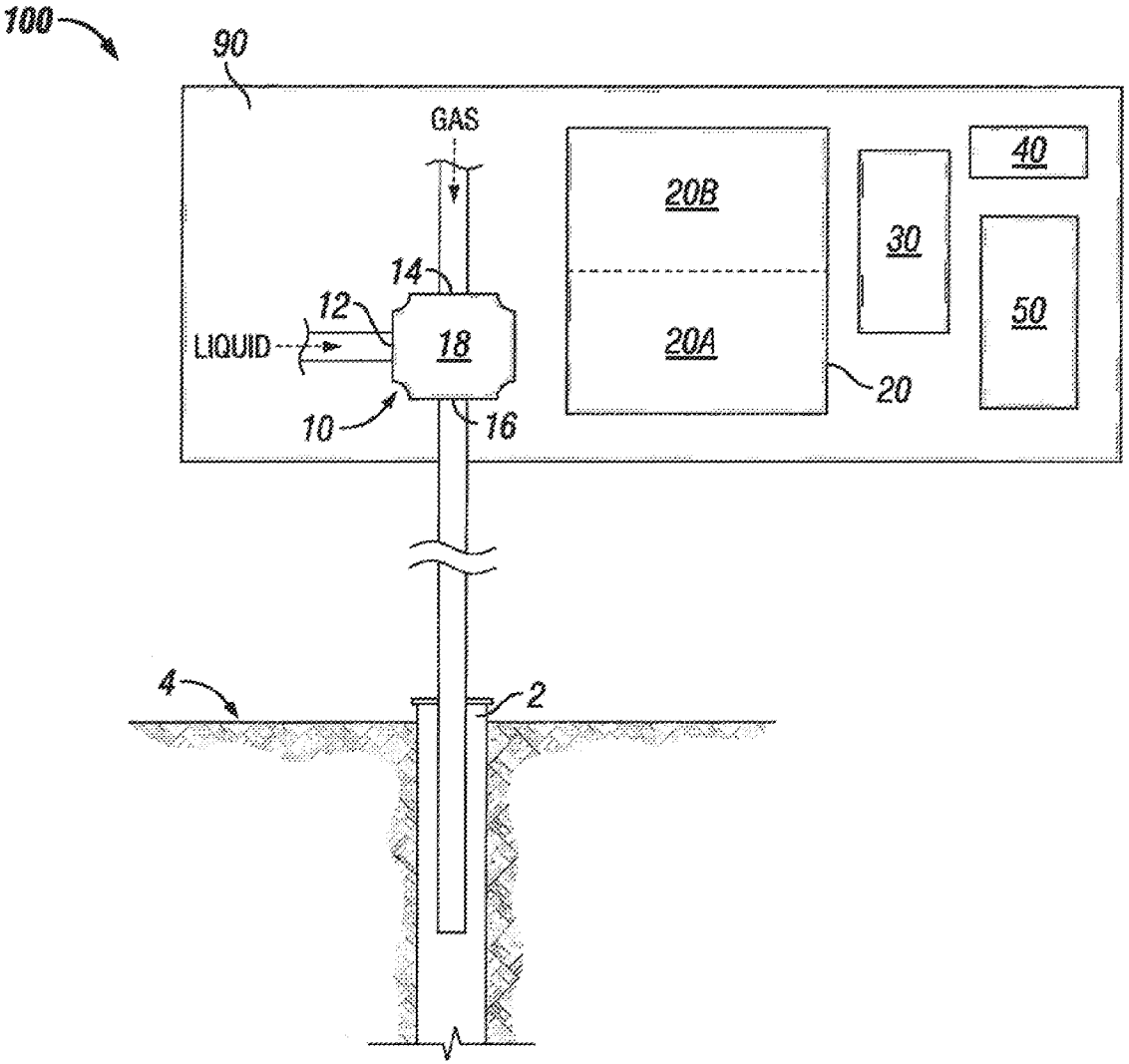
FIG. 1 is a schematic representation of a dual phase mixture generator according to an embodiment of the current application.

According to one aspect, FIG. 1 shows a system for generating high pressure dual phase mixture generally indicated at 100. The system 100 comprises a transportable platform 90, a dual phase mixture generator 10 mounted on the transportable platform 90, a first container 20 mounted on the transportable platform 90, and a first pump 30 mounted on the transportable platform 90, wherein the first pump 30 is operably connected with the first container 20.

In one embodiment, the dual phase mixture generator 10 comprises a mixing chamber 18 that is connected with and is in fluid communication with a first inlet 12, a second inlet 14, and a first outlet 16. The first inlet 12 is configured to receive a base fluid under high pressure. The second inlet 14 is configured to receive a gas under high pressure. The mixing chamber 18 is configured to combine the base fluid received from the first inlet 12 and the gas received from the second inlet 14 to form a high pressure dual phase mixture. The generated dual phase mixture is then discharged from the outlet 16 for use at the wellsite 4, in some cases, the generated high pressure dual phase mixture is pumped into a well 2 located at the wellsite 4.

According to another embodiment, the dual phase mixture is a foamed cement slurry. In some cases, the base fluid is a cement slurry containing a foaming additive. In some cases, the gas is nitrogen, although any suitable gas may be used.

The container 20 contains a foaming additive that may be a foaming agent, a foaming stabilizer, or a mixture thereof. Optionally, the first container 20 is further divided into two separate compartments 20A and 20B, with compartment 20A containing a foaming agent and compartment 20B containing a foaming stabilizer. The foaming agent and stabilizer may be mixed in a desired ratio at the wellsite 4 before the commencement of the well treatment operation. In some cases, the foaming agent and stabilizer are mixed at a 50/50 ratio.

In another embodiment, the container 20 contains liquid nitrogen and the first pump 30 is a liquid nitrogen pump that pumps the nitrogen from the first container 20 into the second inlet 14 of the dual phase mixture generator 10.

Optionally, the system 100 for generating high pressure dual phase mixture further includes a data acquisition and/or control console 40. The console 40 may function as a monitoring device that collects data from various sensors deployed in the system and verifies if the system is operating according to the required specification. (See FIG. 2 of the current application for more details.) Alternatively, the console 40 may function as a control station from where the field operator may enter parameters of a particular foaming project and control the progress of the foaming project. In some embodiments, the console 40 functions as both a monitoring device and a control station.

Optionally, the system 100 for generating high pressure dual phase mixture may further include a power supply 50 supplying energy to the equipment mounted on the transportable platform 90.

Figure 2:
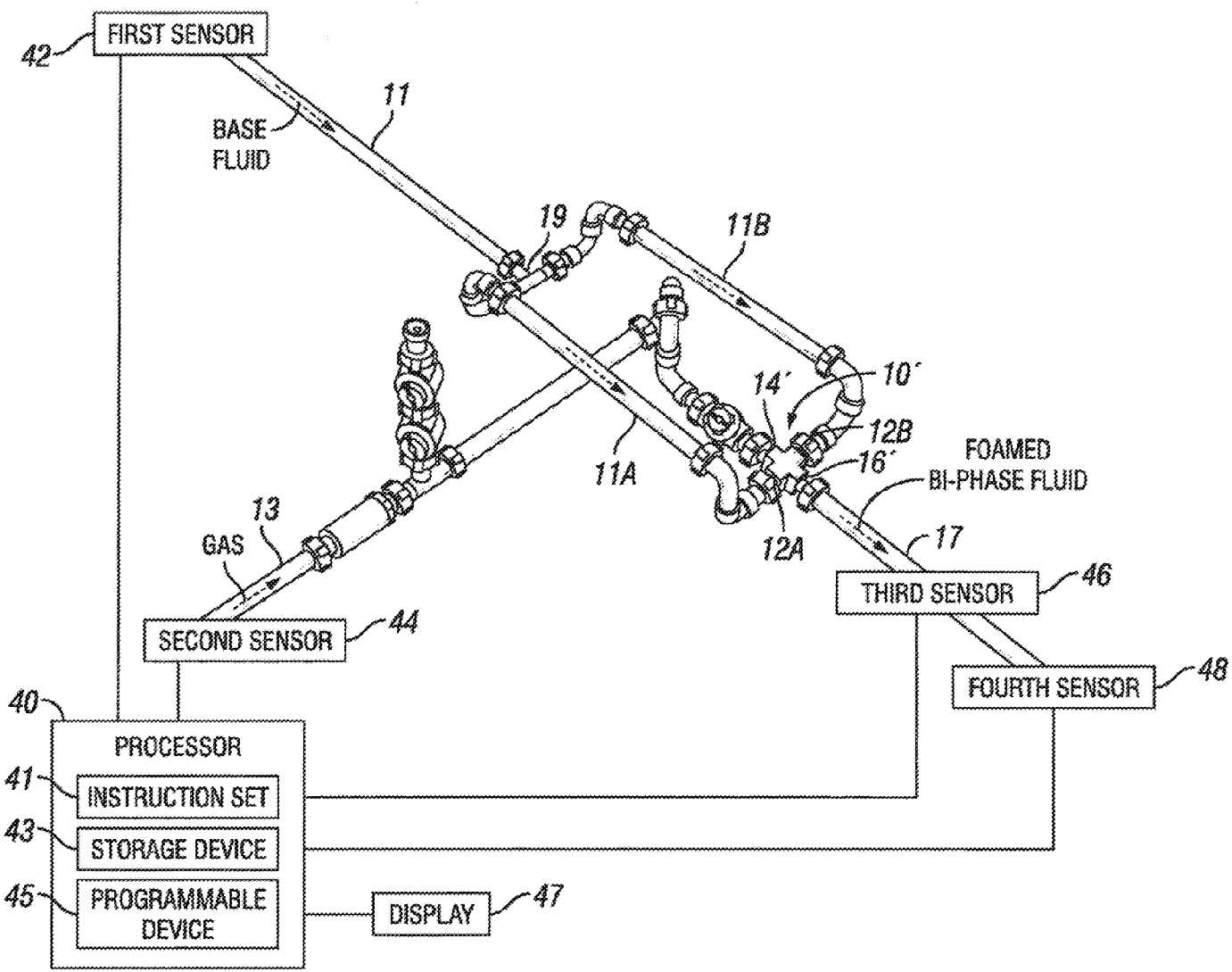
FIG. 2 is a schematic representation of a dual phase mixture generator according to another embodiment of the current application.

Variations to the above depicted system 100 are possible. For example, as shown in FIG. 2 of the current application, the base fluid may be introduced to the system 100 via a fluid conduit 11 and split into two steams 11A and 11B at a "T" connector 19. Steam 11A is then fed into inlet 12A of the dual phase mixture generator 10'. Steam 11B is then fed into inlet 12B of the dual phase mixture generator 10'. The gas component is introduced info the system 100 via a fluid conduit 13 and fed into inlet 14' of dual phase mixture generator 10'. The generated high pressure dual phase mixture is discharged through outlet 16' via fluid conduit 17.

Optionally, the system 100 includes a plurality of sensors 42, 44, 48, 48 in data communication with the console 40 to monitor characteristics of materials flowing through a plurality of conduits 11, 13, 17 that are in fluid communication with each other. As a non-limiting example, the first sensor 42 may be a coriolis flow meter to measure a flow rate of the base fluid flowing through the fluid conduit 11. Similarly, the second sensor 44 is a turbine flow meter measuring a flow rate of a gas flowing through the gas conduit 13. The third sensor 46 may be a pressure transducer to measure a pressure of the foam conduit 17. The fourth sensor 48 may be a temperature sensor for measuring the temperature of a foamed bi-phase fluid flowing in the foam conduit 17. It is understood that any sensors capable of measuring like characteristics of a bi-phase fluid can be used. It is further understood that any number of sensors can be used.

According to one embodiment of the current application, the console 40 is in data communication with each of the sensors 42, 44, 46, 48 to receive data therefrom. The console 40 may be any device or system adapted to receive data from at least one of the sensors 42, 44, 46, 48, analyze the received data based upon an instruction set 41, and calculate at least one parameter of the materials flowing through the conduits 11, 13, 17. The instruction set 41 may be embodied within any computer readable medium, includes processor executable instructions for configuring the console 40 to perform a variety of tasks and calculations.

In certain embodiments, the console 40 includes a storage device 43 such as a solid state storage system, a magnetic storage system, an optical storage system or any other suitable storage system or device. The storage device 30 is adapted to store the instruction set 41 as well as other data and information received and/or calculated by the console 40. The console 40 may further include a programmable device or component 45 that is in communication with any other component of the system 100 such as the sensors 42, 44, 46, 48, for example, in some embodiments, the programmable component 45 is adapted to manage and control processing functions of the console 40, the sensors 42, 44, 46, 48, and/or other components of the system 100.

In operation, a base fluid is caused to flow through the fluid conduit 11 while a gas is caused to flow through the gas conduit 13. The gas is combined with the base fluid to form a foamed bi-phase fluid routed through the foam conduit 17. The sensors 42, 44, 46, 48 measure characteristics of the base fluid, the gas, and the foamed bi-phase fluid, as they pass through the respective conduits 11, 13, 17. Each of the sensors 42, 44, 46, 48 transmits data representing the measured characteristics to the processor of console 40. The processor of console 40 receives the data and uses the measured characteristics to calculate an unknown parameter of the foamed bi-phase fluid. Specifically, based on the measured pressure and temperature from the third sensor 46 and the fourth sensor 48 respectively, the measured characteristics of the fluid in the fluid conduit 11 received from the first sensor 42, the measured characteristics of the gas in the gas conduit 13 received from the second sensor 44, and other known parameters, at feast one of the quality, the density, the flow rate, and the velocity of the bi-phase fluid can be calculated at conditions present in the foam conduit 17. In certain embodiments the calculated parameter of the bi-phase fluid is at least one of presented on a display 47 connected to the processor of console 40 and stored in the storage device 43.

Figure 3:
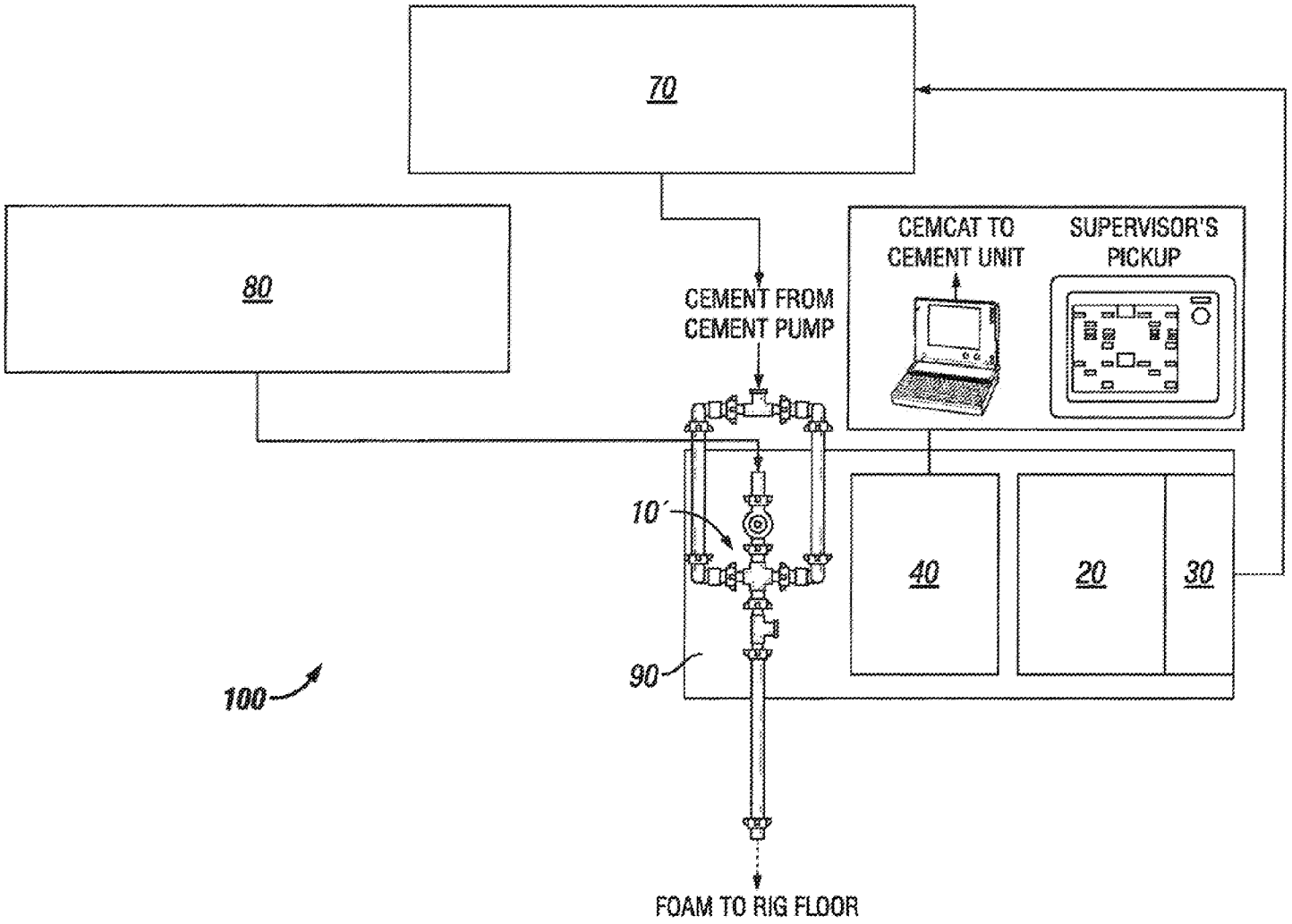
FIG. 3 is a schematic representation of a system for generating a dual phase mixture according to one embodiment of the current application.

Referring now to FIG. 3 of the current application, system 100 is provided for generating high pressure dual phase mixtures where the dual phase mixture is a foamed cement slurry. The system 100 comprises a transportable platform 90, a dual phase mixture generator 10' mounted on the transportable platform 90, a first container 20 mounted on the transportable platform 90, and a first pump 30 mounted on the transportable platform 90, where the first pump 30 is operably connected with the first container 20.

In one embodiment, system 100 further includes a data acquisition/control console 40, cement generating equipment 70 and nitrogen supply unit 80. The data acquisition/control console 40 acquires data from sensors deployed in the system 100, analyzes the data, monitors the status of the system 100, and/or controls the operation of the system 100, according to the description set forth above.

The cement generating equipment 70 produces cement slurries and feeds the cement slurries into the dual phase mixture generator 10', in one embodiment, the cement generating equipment 70 comprises a high pressure pump (not shown) having a suction side and a discharge side. The suction side is under a low pressure, which receives a cement slurry from other components of the cement generating equipment 70 and the foaming additive(s) from a source, such as the first pump 30 and the first container 20 according to one embodiment. The discharge side of the high pressure pump is under a high pressure, which pumps the mixture of the cement slurry and the foaming additive(s) under the high pressure into inlet 12, 12A, 12B of the dual phase mixture generator 10, 10'.

Alternatively, the foaming additive(s) can be added directly to conduit 11, 11A, or 11B or at the position where the "T" connector 19 occupies, as depicted in FIG. 2. In this embodiment, the foaming additive(s) will bypass the cement generating equipment 70. The cement slurry generated by equipment 70 mixes with the foaming additive(s) in conduit 11, 11A, or 11B and the mixture thereof is introduced into the dual phase mixture generator 10, 10' via the first inlet 12, 12A, 12B.

In the depicted embodiment in FIG. 3, the cement generating equipment 70 is not mounted on the transportable platform 90, but instead, positioned at a distance from the transportable platform 90. In some cases, the cement generating equipment 70 is mounted on a separate truck or platform; in some other cases, the cement generating equipment 70 is positioned on the ground at the wellsite 4. However, it is understood that the cement generating equipment 70 or a portion thereof can be mounted on the transportable platform 90 as well.

In FIG. 3, the system 100 further comprises a nitrogen supply unit 80 that supplies nitrogen to the dual phase mixture generator 10'. The nitrogen supply unit 80 may comprise a container, such as a tank, containing a high pressure nitrogen pump and a nitrogen pump that pumps nitrogen under high pressure into inlet 14 of the system 100. Alternatively, the nitrogen supply unit 80 may comprise a series of nitrogen bottles containing compressed nitrogen gas. It is understood that in order to deliver high pressure nitrogen gas, a series of nitrogen bottles must be employed because each individual nitrogen bottle typically can only deliver nitrogen gas at about 50 to 250 psi maximum, in some embodiments, 5 nitrogen bottles are connected together to achieve the necessary high pressure. In some other cases, 10 nitrogen bottles are employed. In some further cases, 25 nitrogen bottles are connected together for a foaming operation. Variations to the numbers of nitrogen bottles are thus within the teachings of the current application.

In FIG. 3, the depicted embodiment shows that the nitrogen supply unit 80 is not mounted on the transportable platform 90, but instead is positioned at a distance from the transportable platform 90 in some cases, the nitrogen supply unit 80 is mounted on a separate truck or platform; in some other cases, the nitrogen supply unit 80 is simply rested on the ground at the wellsite. However, it is understood that the nitrogen supply unit 80 or a portion thereof can be mounted on the transportable platform 90 as well.

Figure 4:
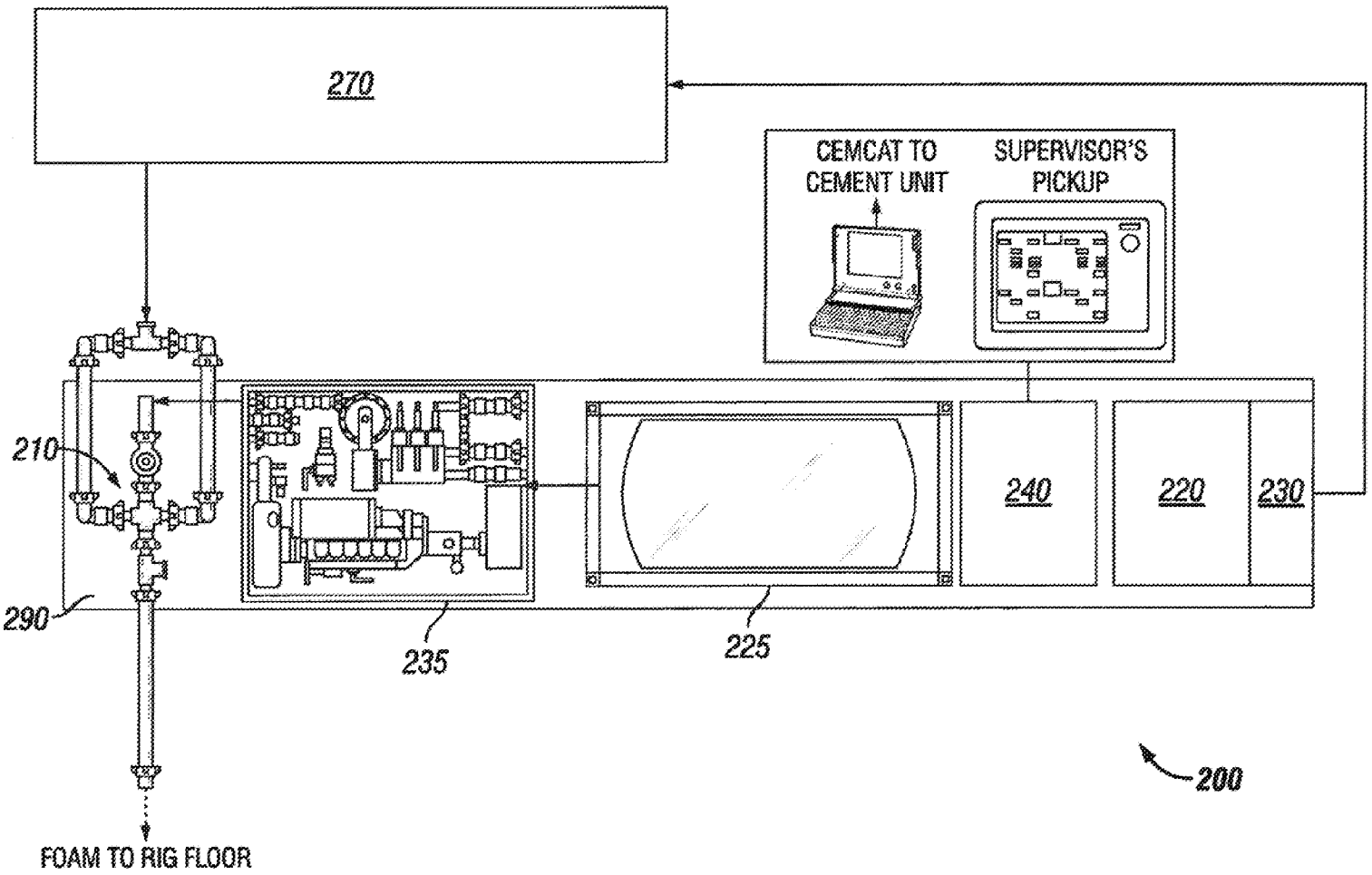
FIG. 4 is a schematic representation of another system for generating a dual phase mixture according to another embodiment of the current application.

Accordingly, as shown in FIG. 4 in accordance with another embodiment, system 200 is provided for generating high pressure dual phase mixture, where the system comprises a dual phase mixture generator 210 mounted on a transportable platform 290, a first container 220 that is mounted on the transportable platform and is operably connected to a first pump 230, and a second container 225 that is mounted on the transportable platform 290 which is operably connected to a second pump 235, where the first container 220 contains a foaming additive and the second container 225 contains a source of a gas. System 200 may further include cement generating equipment 270 that is either mounted or not mounted on the transportable platform 290.

The transportable platform 90, 290 can be in any form perceivably by people skilled in the art in view of the teachings of the current application, in some embodiments, the transportable platform 90, 290 is a chassis of a road legal truck. In some other embodiments, the transportable platform 90, 290 is a deck or a portion of a deck of a ship, vessel, or a towboat. In some additional embodiments, the transportable platform 90, 290 is a flatbed or grillage that can be lifted and mounted on a transportation vehicle, such as a truck, a frailer, a ship, a vessel, or a towboat, etc. Variations to the form of the transportable platform 90, 290 are within the disclosure of the current application.

The preceding description has been presented with reference to some illustrative embodiments of the Inventors' concept. Persons skilled in the art and technology to which this invention pertains will appreciate that alterations and changes in the described structures and methods of operation can be practiced without meaningfully departing from the principle, and scope of this invention. Accordingly, the foregoing description should not be read as pertaining only to the precise structures described and shown in the accompanying drawings, but rather should be read as consistent with and as support for the following claims, which are to have their fullest and fairest scope.

We claim:

1. A method of generating high pressure dual phase mixture, comprising:

mounting a dual phase mixture generator on a transportable platform, wherein the dual phase mixture generator comprises a mixing chamber connected with a first inlet, a second inlet, and a first outlet;

mounting a first container and a first pump on the transportable platform, wherein the first pump is operably connected with the first container;

mounting a second container and a second pump on the transportable platform, where the second container comprises a source of gas, and wherein the second pump is operably connected with the second container and the second inlet;

deploying the transportable platform at a wellsite;

introducing a base fluid and a foaming additive into the first inlet;

pumping a gas into the second inlet from the second container under high pressure;

combining the base fluid with the gas in the mixing chamber to generate a high pressure dual phase mixture; and, discharging the generated high pressure dual phase mixture via the outlet.

2. The method of claim 1, further comprising introducing the high pressure dual phase mixture into a well, at the wellsite.

3. The method of claim 1, wherein the dual phase mixture is a foamed cement slurry.

4. The method of claim 3, wherein the base fluid is a cement slurry containing the foaming additive and the gas is nitrogen.

5. The method of claim 4, wherein the cement slurry containing the foaming additive is produced by cement generating equipment, the equipment being mounted on the transportable platform, not mounted on the transportable platform, or partially mounted on the transportable platform.

6. The method of claim 5, wherein the first container contains the foaming additive and the first pump pumps the foaming additive to the cement generating equipment for mixing with the cement slurry, and a mixture of the foaming additive and the cement slurry is introduced into the first inlet of the dual phase mixture generator.

7. The method of claim 6, wherein the foaming additive is a foaming agent, foam stabilizer, or a mixture thereof.

8. The method of claim 7, wherein the first container comprises two separate compartments, and wherein a first compartment contains the foaming agent and a second compartment containing the foam stabilizer.

9. The method of claim 5, wherein the first pump pumps the foaming additive to the cement generating equipment for mixing with the cement slurry produced therein, and a mixture of the foaming additive and the cement slurry is introduced into the first inlet of the dual phase mixture generator, and wherein the second container contains liquid nitrogen.

10. The method of claim 9, wherein the cement generating equipment comprises a high pressure pump and the foaming additive is pumped into a suction end of the high pressure pump.

11. The method of claim 9, wherein the transportable platform is mounted on a trailer or a vessel.

12. A system for generating high pressure dual, phase mixture, the system comprising:

a transportable platform;

a dual phase mixture generator mounted on the transportable platform;

wherein the dual phase mixture generator comprises a mixing chamber connected with at least a first inlet, a second inlet, and a first outlet, and wherein the first inlet is configured to receive a base fluid under high pressure, the second inlet is configured to receive a gas under high pressure, the mixing chamber is configured to combine the base fluid and the gas to generate a high pressure dual phase mixture, and the outlet is configured to discharge the generated high pressure dual phase mixture;

a first container and a first pump mounted on the transportable platform, wherein the first pump is operably connected with the first container; and, a second container and a second pump mounted on the transportable platform, wherein the second container comprises a source of gas, and wherein the second pump is operably connected with the second container and the second inlet to introduce the gas under high pressure.

13. The system of claim 12, wherein the transportable platform is mounted on a trailer or a vessel.

14. The system of claim 12, wherein the dual phase mixture is a foamed cement slurry, the base fluid is a cement slurry containing a foaming additive, and the gas is nitrogen.

15. The system of claim 14, wherein the cement slurry containing a foaming additive is produced by cement generating equipment, the equipment being mounted on the transportable platform, not mounted on the transportable platform, or partially mounted on the transportable platform.

16. The system of claim 15, wherein the first container contains the foaming additive selected from a foaming agent, a foam stabilizer, or a mixture thereof.

17. The system of claim 16, wherein the first container comprises two separate compartments, and wherein a first compartment contains the foaming agent and a second compartment containing the foam stabilizer.

18. The system of claim 15, wherein the first container contains a foaming additive and the first pump pumps the foaming additive to the cement generating equipment for mixing with the cement slurry produced therein, and a mixture of the foaming additive and the cement slurry is introduced into the first inlet of the dual phase mixture generator, and wherein the second container contains liquid nitrogen and the second pump pumps the liquid nitrogen from the second container into the second inlet of the dual phase mixture generator.

19. The system of claim 12, further comprising a control panel that monitors a condition of the apparatus and/or controls a process of generating high pressure dual phase mixture.

* * * * *